US007059424B2

(12) United States Patent
Neal et al.

(10) Patent No.: US 7,059,424 B2
(45) Date of Patent: Jun. 13, 2006

(54) APPARATUS FOR ROTATING A THREADED CLOSURE DEVICE

(75) Inventors: Kenneth G. Neal, Duncan, OK (US); Paul A. Brown, Duncan, OK (US); William D. Kendrick, Duncan, OK (US); Todd J. Dean, Comanche, OK (US); Brad R. Bull, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 35 days.

(21) Appl. No.: 10/818,003

(22) Filed: Apr. 5, 2004

(65) Prior Publication Data

US 2005/0217877 A1 Oct. 6, 2005

(51) Int. Cl.
*B25D 1/10* (2006.01)
*B25D 17/08* (2006.01)

(52) U.S. Cl. ..... 173/104; 173/90; 173/128

(58) Field of Classification Search ..... 173/90, 173/93, 104, 128, 133; 81/52, DIG. 1, DIG. 3
See application file for complete search history.

(56) References Cited

U.S. PATENT DOCUMENTS 1,054,687 A 3/1913 Grigg
1,154,922 A * 9/1915 Hansen ..... 173/104
1,941,565 A 1/1934 Mandl
3,762,022 A * 10/1973 Jeune ..... 29/275
4,253,353 A 3/1981 Symbol
4,299,293 A * 11/1981 Nikolaev et al. ..... 173/104
4,634,154 A 1/1987 Arora et al.
5,526,722 A * 6/1996 Limehouse ..... 81/466
6,705,409 B1 * 3/2004 Paul ..... 173/132
6,748,832 B1 * 6/2004 Maxwell ..... 81/462
6,802,377 B1 * 10/2004 Foltz ..... 173/1
6,889,591 B1 * 5/2005 Sabates et al. ..... 89/1.14

OTHER PUBLICATIONS

Ingersoll-Rand Catalog, pp. 13-15 (undated but admitted to be prior art).

* cited by examiner

*Primary Examiner*—Scott A. Smith
*Assistant Examiner*—Gloria R. Weeks
(74) *Attorney, Agent, or Firm*—John W. Wustenberg; McAfee & Taft

(57) ABSTRACT

An apparatus for rotating a threaded tightening device includes a guide and an anvil utilized to impact a lug on the threaded tightening device to rotate the tightening device onto or off of a threaded member. The guide has a frame with a support sleeve attached thereto. A reciprocating device is received in and is supported by the support sleeve. The anvil is attached to the reciprocating device. When the reciprocating device is received in and is supported by the support sleeve, actuation of the reciprocating device will cause the anvil to repeatedly impact a lug to rotate the threaded tightening device in the desired direction.

19 Claims, 4 Drawing Sheets

APPARATUS FOR ROTATING A THREADED CLOSURE DEVICE

BACKGROUND

The current invention is directed to an apparatus for rotating a threaded device, and more specifically to an apparatus for rotating and thus tightening or loosening a wing union nut, such as a wing union nut utilized in connecting high pressure manifold equipment.

There are a number of applications in the oil and gas industry which require the placement of threaded closure, connecting or tightening devices. Threaded nuts, caps, and other devices may be utilized to close the end of a tube or to connect threaded members together. Many such devices are essentially comprised of a body with an internal thread and a plurality of lugs. Space restraints and sometimes location often make the rotation of the threaded devices difficult. For example, wing union nuts utilized for high pressure manifold equipment are currently tightened using a hammer to hit the lugs on the wing union nut. It is difficult in confined spaces and/or in elevated locations such as a derrick to hammer the wing nut. Oftentimes, the hammer will glance off the lug or will miss the lug completely. Such situations can be a safety hazard to the operator and may also cause damage to other equipment.

SUMMARY

The current invention provides an apparatus for rotating a threaded device onto or off of a threaded member or members. The threaded device may comprise, for example, a threaded closure, connecting or securing device such as a cap device utilized to close a threaded container, or a wing union nut utilized to connect threaded members in high pressure manifold equipment. The threaded device may comprise a threaded body having a plurality of lugs extending from the body. The apparatus of the current invention includes a guide which will support a reciprocating anvil. The reciprocating anvil is positioned to impact one of the lugs so that it will rotate the threaded device in the desired direction.

The apparatus also includes a reciprocating device. The anvil is received in the reciprocating device, which will reciprocate the anvil so that it repetitively impacts the lug to rotate the tightening device. The guide may include a support frame with a support sleeve connected thereto. The support frame has a pair of opposed side plates, and the support sleeve is mounted between the side plates. The reciprocating device is received in the support sleeve and is positioned so that the anvil impacts one of the lugs on the threaded tightening device. Another of the lugs is received in a slot in the frame. The support frame will contact the body of the threaded device when the reciprocating device is being used to reciprocate the anvil so as to impact a lug and rotate the tightening device.

BRIEF DESCRIPTION OF THE DRAWINGS

FIG. 5 is a partial cross-sectional view of the apparatus of the present invention.

FIG. 6 is a perspective view of the invention.

DETAILED DESCRIPTION

Figure 1:
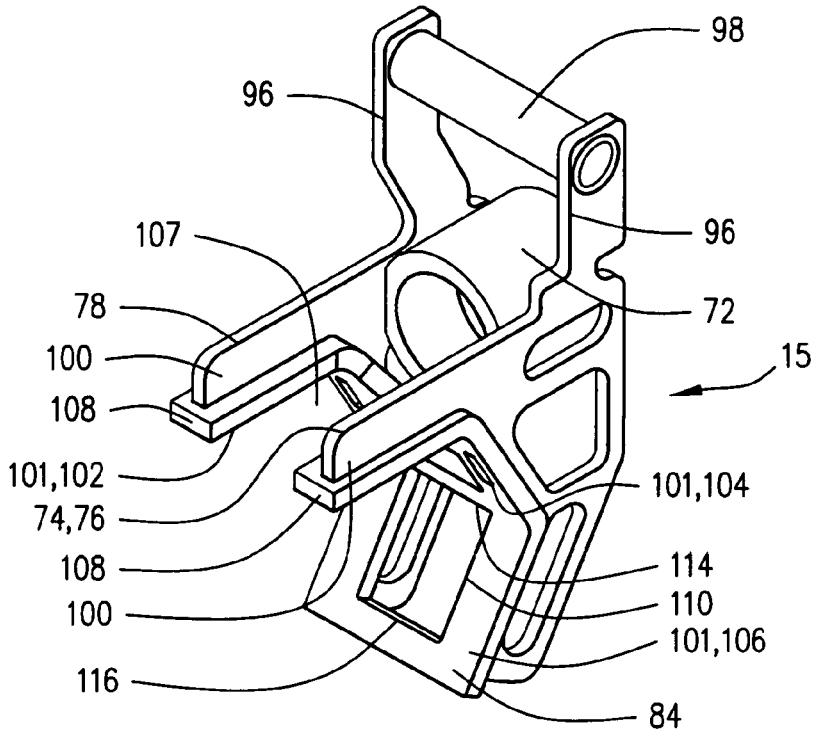
FIG. 1 is a perspective view of the guide of the present invention.
Figure 2:
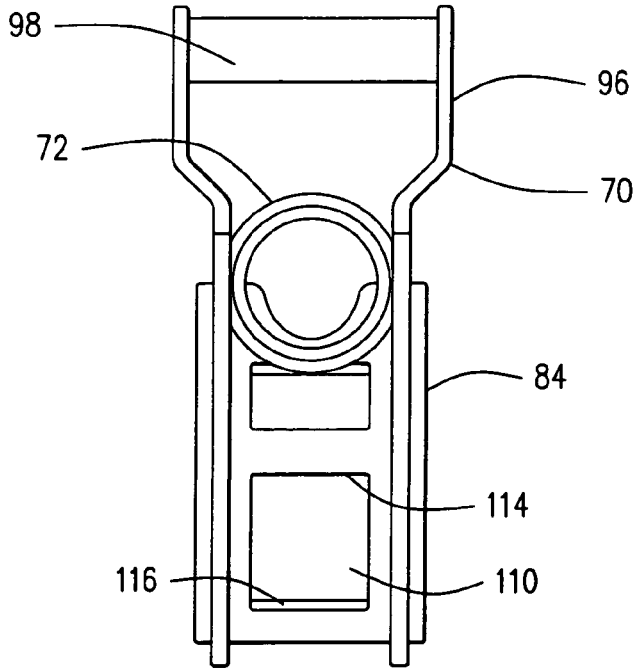
FIG. 2 is a view of the back or rear side of the guide of the present invention.

Referring now to the drawings and more particularly to FIG. 6, the apparatus 10 for rotating a threaded device is shown. Apparatus 10 comprises a guide 15 for supporting an anvil or hammer tool 20. Anvil 20 is received in a reciprocating device 25. Apparatus 10 is used to rotate a threaded device 30, such as a wing union nut 30 which is comprised of a body 32 having internal threads 34 and 36 therein. Wing union nut 30 may be for example a wing union nut of a type utilized for connecting high pressure manifold equipment. As is known in the art, threads 34 and 36 may be directionally opposite threads, so that rotation of the device 30 in one direction will connect two threaded members, and rotation in the opposite direction will disconnect the threaded members. A plurality of lugs 38 extend outwardly from body, or body portion 32. Guide 15 supports anvil 20 so that anvil 20 is positioned and adapted to impact or engage one of the plurality of lugs 38 to rotate threaded device 30 in the desired direction to tighten and/or loosen the threaded device 30 onto or off of threaded members (not shown) as is known in the art. Anvil 20 is preferably received in and attached to reciprocating device 25, which may be for example a chipping hammer. Reciprocating device 25 is supported by guide 15, so that actuation of reciprocating device 25 will cause anvil 20 to repeatedly impact one of the lugs 38 in a jackhammer effect to rotate threaded device 30.

Reciprocating device 25 may comprise a chipping hammer such as, for example, an Ingersoll-Rand W Series chipping hammer comprising a handle or handle portion 40 and a barrel or barrel portion 42. As is known in the art, a rubber buffered retainer 44 such as for example Ingersoll-Rand part number HHW 1-A300 may be threaded to a forward end 43 of barrel 42. Retainer 44 may include, as is known in the art, upper and lower buffer washers 46 and 48, respectively, which may be, for example, H3R-31 and HHW1-213 upper and lower buffer washers. A rubber bumper 50 such as, for example, Ingersoll-Rand Part No. H3R-203 may be positioned between upper and lower buffer washers 46 and 48, respectively. A lock clip 52 may be disposed about a groove 54 in retainer 44. The arrangement of parts described herein is essentially a standard arrangement for rubber buffer retainer 44.

Anvil 20 has first, or forward end 58 adapted to impact a lug 38, and a second, or rear end (not shown) received in reciprocating device 25. Anvil 20 has a shoulder or collar 60 positioned between first end 58 and the second end thereof. Anvil 20 is mounted to reciprocating device 25 such that actuation thereof will cause anvil 20 to reciprocate in a jackhammer effect so that it will repetitively impact one of the lugs 38 on the threaded device being rotated, such as threaded device 30. First, or forward end 58 of anvil 20 is preferably a blunt, flat end adapted to engage or impact one of lugs 38. Anvil 20 is similar to other tools that may be utilized with a chipping hammer, such as, for example, a one-inch flat chisel, Ingersoll-Rand H3R series. Anvil 20, however, has a blunt end to impact lugs 38, rather than a blade or chisel end.

Guide 15 supports reciprocating device 25 and thus supports anvil 20 and positions anvil 20 to impact a lug 38. The jackhammer effect of reciprocating device 25 will cause anvil 20 to repeatedly engage a lug 38 and rotate threaded device 30 in the desired direction. Thus, if threaded device 30 is a wing union nut, rotation thereof will cause the wing union nut to be threaded onto, or off of high pressure manifold equipment known in the art. Retainer 44 is a modified retainer and has a groove 62 defined in an outer surface thereof. When barrel portion 42 is positioned in guide 15, a retainer 64, such as a split ring retainer, is placed in groove 62 to prevent reciprocating device 25 from inadvertent removal from guide 15.

Guide 15 comprises a frame 70, which may be referred to as support frame 70, and a sleeve or support sleeve 72. Support frame 70 comprises a pair of opposed side plates 74 which may comprise first and second side plates 76 and 78, respectively. Side plates 76 and 78 are preferably mirror images of one another and include a plurality of lightening holes 80. Side plates 74 have an edge 82 to which a support plate 84 is affixed by welding or other means known in the art. Support sleeve 72 is positioned between side plates 76 and 78 and is mounted thereto by welding or other means known in the art. Support sleeve 72 has a first or forward end 88 and a second or rear end 90. Support sleeve 72 defines a first inner diameter 92 extending forward from the rear end 90 thereof and a second inner diameter 94 concentric with diameter 92. Second inner diameter 94 is smaller than first inner diameter 92.

Figure 3:
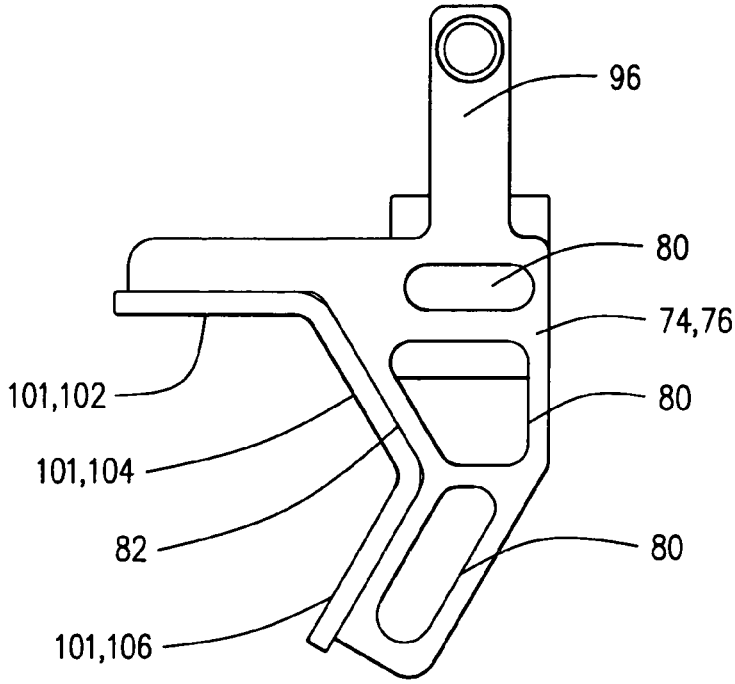
FIG. 3 is a right side view of the guide of the present invention, the left side view being a mirror image thereof.
Figure 4:
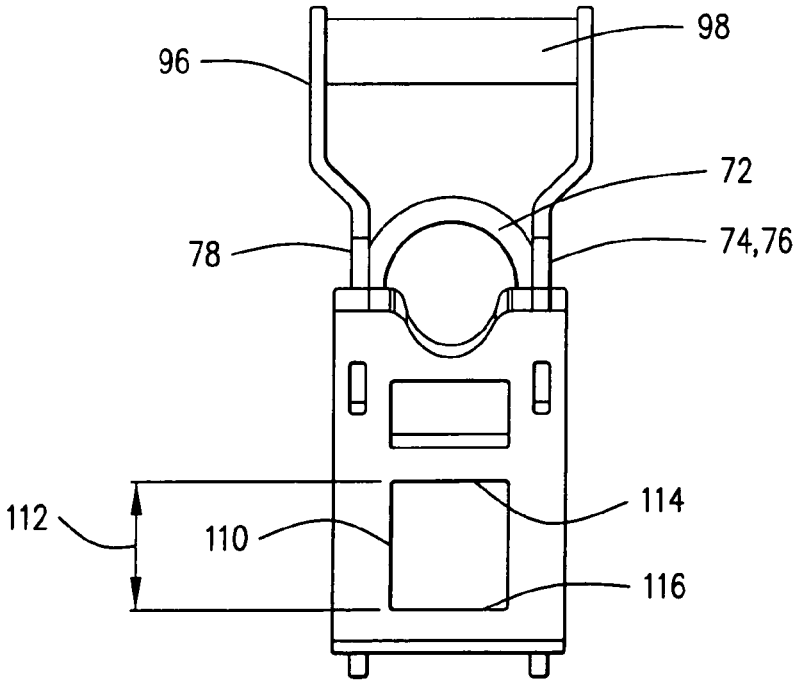
FIG. 4 is a view of the front or forward side of the guide of the present invention.
Figure 3:
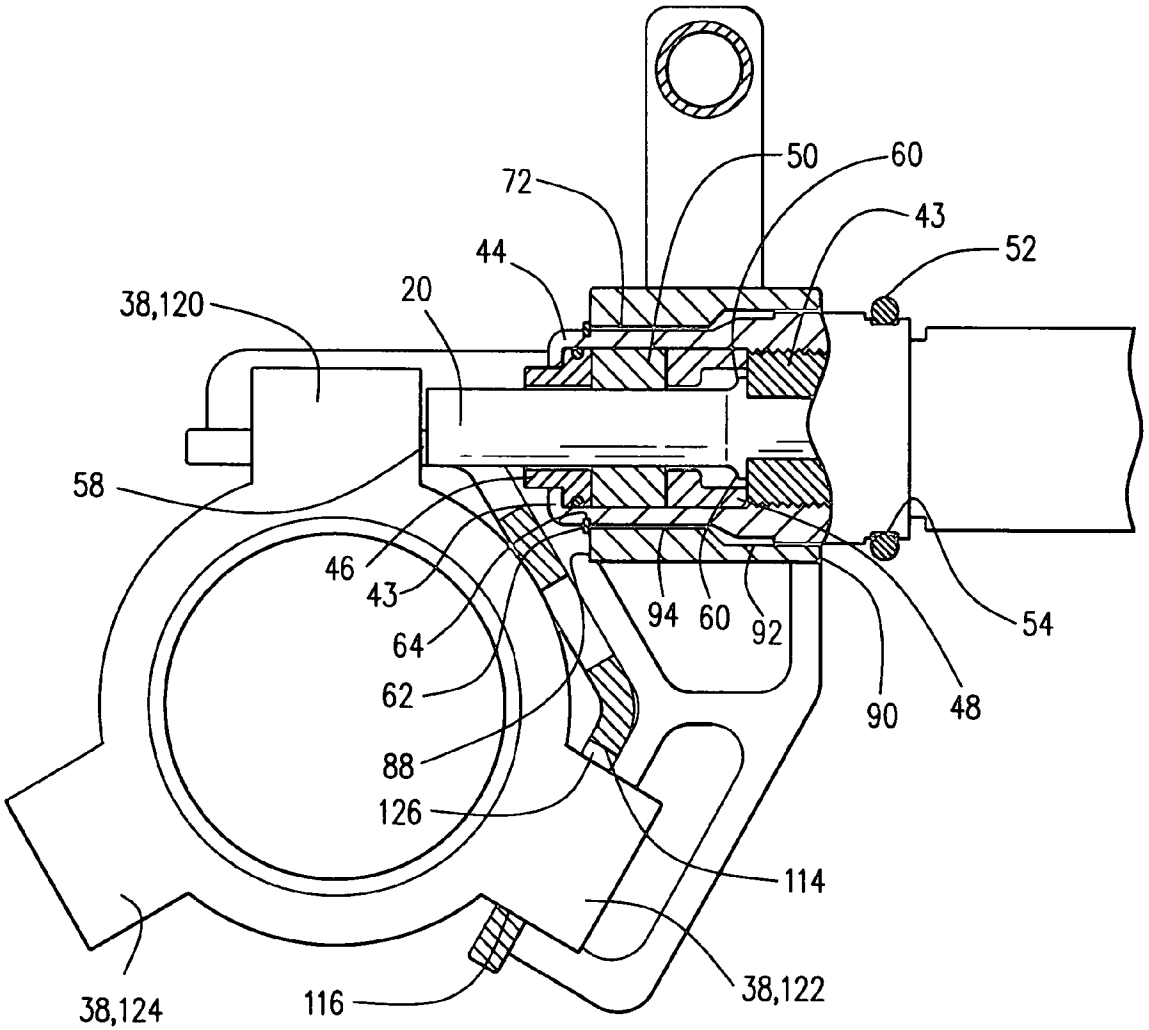
Figure 3:
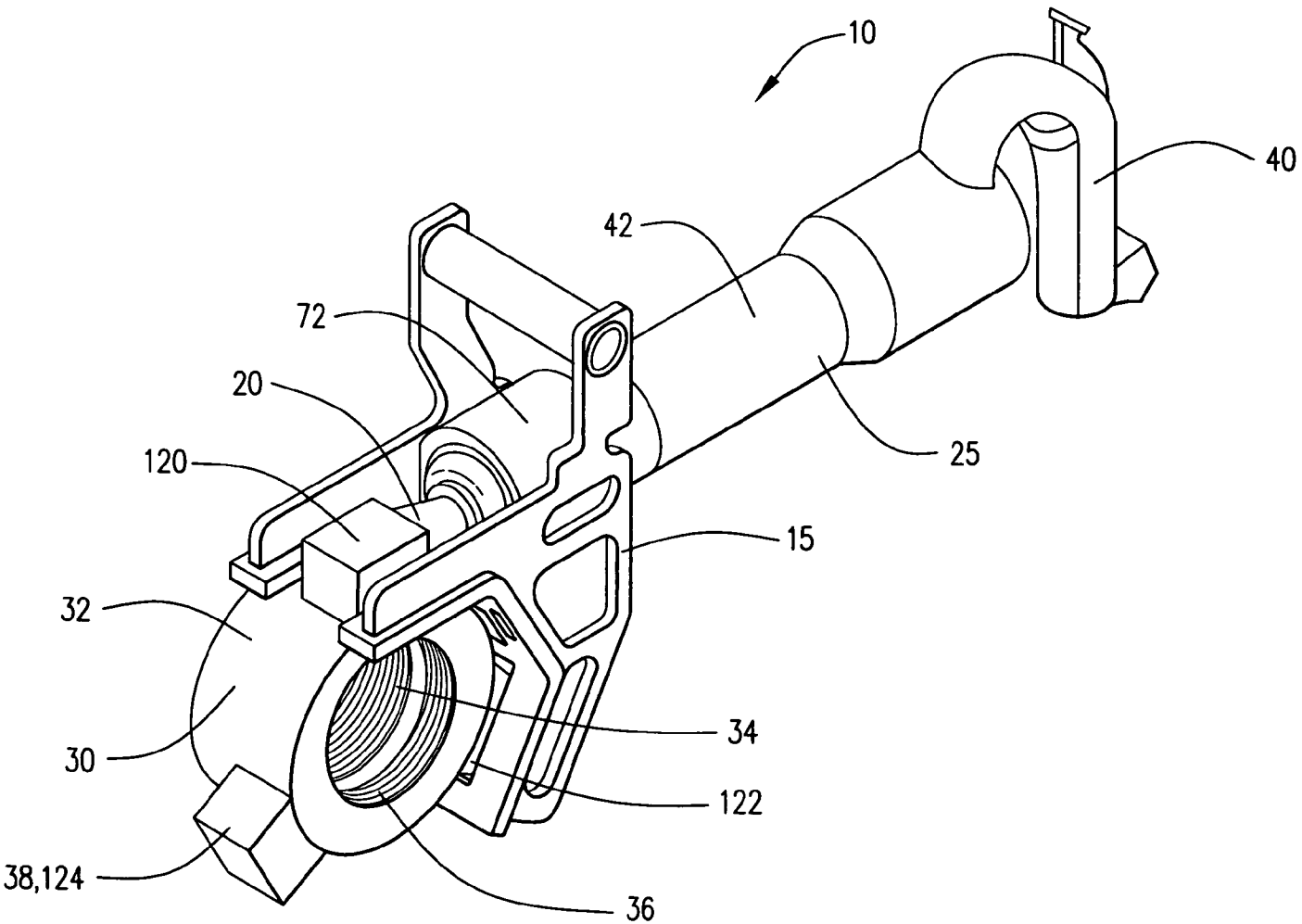

As viewed in FIG. 3, each side plate 74 has an ear 96 that extends upwardly above support sleeve 72 so that side plates 74 define a pair of opposed ears 96 to which a handle 98 may be attached. Side plates 74 also define ribs 100 which extend forward from forward end 88 of support sleeve 72.

Support plate 84 has three sides 101 designated first, second and third sides 102, 104 and 106 and in the side view shown in FIG. 3 have a shape which is generally that of a half hexagon. First side 102 has a slot 107 therethrough to define a pair of support panels 108 to which ribs 100 are affixed. Third side 106 defines an opening 110 which may be a generally rectangularly shaped opening 110 that is adapted to be placed over a lug 38 and to provide room for the lug 38 to move therein. Opening 110, which may be referred to as a lug-receiving slot or opening, has a height 112 extending between a top edge 114 and a bottom edge 116 thereof.

Guide 15 is positioned so that one of lugs 38, which will be referred to for ease of reference as lugs 120, 122 and 124 is received in opening 110. In the embodiment shown, the lug 122 is received in opening 110. A space 126 is defined between lug 122 and the upper edge or top 114 of opening 110. Another of lugs 38 and in the embodiment shown lug 120 which is a lug adjacent lug 122 is positioned in slot 107 between panels 108 and ribs 100.

To operate apparatus 10, reciprocating device 25 is inserted in support sleeve 72. Specifically, retainer 44 is received in support sleeve 72. Split ring retainer 64 is placed in groove 62 to prevent reciprocating device 25 from inadvertently slipping out of support sleeve 72. One of lugs 38 is received in opening 110 defined in guide 15, in this case lug 122, while an adjacent lug 38, in this case lug 120, is positioned to be impacted by anvil 20. Reciprocating device 25 creates a jackhammer effect to rotate the threaded device 30 in the desired direction to tighten or loosen the threaded device, or to connect or disconnect threaded members. In the case of a closure device, the threaded device 30 is rotated to open or close the member which is threadedly engaged. Because opening 110 has a height which provides space 126, threaded device 30 will move when reciprocating device 25 is actuated to cause the anvil 20 to impact lug 120. Reciprocating device 25 can be rotated relative to a central axis of barrel portion 42 using handle portion 40, which provides for easy positioning and actuation in confined spaces or locations that are difficult to access.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. Apparatus for rotating a threaded device onto or off of a threaded member, the apparatus comprising:
- an anvil;
- a reciprocating device for reciprocating the anvil to repeatedly impact a lug on the threaded device; and
- a guide for supporting the reciprocating device, the guide comprising:
  - a frame for engaging a body portion of the threaded device; and
  - a support sleeve attached to the frame, wherein the reciprocating device is received in and supported by the support sleeve.

2. The apparatus of 1 wherein the frame comprises a pair of opposed support plates, the support sleeve being affixed to the opposed support plates.

3. The apparatus of 1 wherein the frame comprises a pair of support panels extending forward from the support sleeve, wherein the lug impacted by the anvil is interposed between the pair of support panels.

4. The apparatus of claim 3 wherein the support panels engage the body portion of the threaded device.

5. The apparatus of 1 further comprising a handle attached to the frame.

6. The apparatus of 1 wherein the frame defines a lug-receiving slot for receiving a lug on the threaded device other than the lug to be impacted, wherein the lug is movable in the lug-receiving slot.

7. Apparatus for threading a threaded nut onto or off of a threaded member comprising:
- a frame;
- a support sleeve mounted to the frame;
- a reciprocating device removably insertable into the support sleeve; and
- an anvil received in the reciprocating device, the frame being positionable to direct the anvil toward a lug on the threaded nut, so that the anvil will impact the lug and rotate the threaded nut when the reciprocating device is actuated wherein the frame defines a slot for receiving a lug adjacent the lug to be impacted.

8. The apparatus of claim 7 wherein the frame has a handle attached thereto.

9. The apparatus of claim 7 wherein the reciprocating device is a chipping hammer.

10. The apparatus of claim 7 wherein the threaded nut comprises a wing union nut.

11. Apparatus for rotating a threaded device comprising:
- a support guide;
- a reciprocating device supported by the support guide; and
- an anvil mounted in the reciprocating device, the support guide being positionable adjacent the threaded device so that the anvil will engage and rotate the threaded device on a threaded member when the reciprocating device is actuated; wherein the support guide is supported by the threaded device.

12. The apparatus of claim 11, wherein the anvil is adapted to impact a lug on the threaded device to cause the threaded device to rotate on a threaded member.

13. Apparatus of claim 11, the support guide defining a slot therein, wherein the slot is adapted to receive a lug on the threaded device.

14. The apparatus of claim 11 wherein the support guide comprises:

a frame for engaging a body portion of the threaded device; and a sleeve for receiving the reciprocating device.

15. The apparatus of claim 14, wherein the sleeve orients the reciprocating device so that the anvil is directed toward a lug on the threaded device.

16. A guide for supporting a reciprocating device comprising:

a frame; and a support sleeve for receiving the reciprocating device and for supporting at least a portion of the weight of the reciprocating device, the guide being positionable proximate a threaded nut having lugs thereon to direct an anvil carried by the reciprocating device toward and into a lug on the threaded nut, wherein the frame defines a slot for receiving a lug on the threaded nut spaced from the lug to be impacted.

17. The guide of claim 16, wherein the support sleeve positions the anvil so that it is directed in a desired direction.

18. The guide of claim 16 wherein the frame comprises a pair of support panels defining a space therebetween for receiving a portion of the threaded nut therebetween, the frame having an engagement surface for engaging the threaded nut.

19. The guide of claim 18, the space between the panels comprising a slot for receiving a portion of the threaded nut.

* * * * *